US005155910A

United States Patent [19]

Henseler et al.

[11] Patent Number: 5,155,910

[45] Date of Patent: Oct. 20, 1992

[54] PROCESS FOR MANUFACTURING A DOCTOR BAR

[75] Inventors: Klaus Henseler, Heidenheim; Rudolf Beisswanger, Steinheim; Hans-Peter Sollinger, Heidenheim, all of Fed. Rep. of Germany

[73] Assignee: J. M. Voith GmbH, Heidenheim, Fed. Rep. of Germany

[21] Appl. No.: 801,014

[22] Filed: Dec. 2, 1991

Related U.S. Application Data

[62] Division of Ser. No. 555,721, Jul. 19, 1990, Pat. No. 5,103,759.

[30] Foreign Application Priority Data

Jul. 19, 1989 [DE] Fed. Rep. of Germany ..... 3923850

[51] Int. Cl.[5] ..... B21D 53/12

[52] U.S. Cl. ..... 29/895.213; 29/895.21; 29/895.3; 29/125

[58] Field of Search ..... 29/895.2, 895.21, 895.213, 29/895.3, 121.1, 121.6, 125, 130, 132; 118/110, 118, 262

[56] References Cited

U.S. PATENT DOCUMENTS

| | | | |
|---|---|---|---|
| 1,428,142 | 9/1922 | Canda | 29/125 |
| 1,517,036 | 3/1924 | Wagner | 29/125 |
| 2,416,123 | 2/1947 | Siemen | 29/895.213 X |
| 2,429,491 | 10/1947 | Schuler | 29/895.213 X |
| 2,808,616 | 10/1957 | Baldasarre et al. | 18/2.6 |
| 2,961,336 | 11/1960 | Unleen | 117/49 |
| 3,008,220 | 11/1961 | Sammarco | 29/895.213 |
| 3,336,866 | 8/1967 | Hawthorne | 101/348 |
| 3,364,546 | 1/1968 | Martin | 29/895.213 |
| 3,457,618 | 7/1969 | O'Neal et al. | 29/125 |
| 4,325,995 | 4/1982 | Tamura et al. | 427/428 |
| 4,352,230 | 10/1982 | Sukenik | 29/125 |
| 4,462,456 | 7/1984 | Kameyama et al. | 164/448 |
| 4,920,630 | 5/1990 | Leanna | 29/125 X |
| 4,932,111 | 6/1990 | Kark | 29/125 X |

*Primary Examiner*—Timothy V. Eley
*Assistant Examiner*—C. Richard Martin
*Attorney, Agent, or Firm*—Baker & Daniels

[57] ABSTRACT

A doctor bar consists of two different circular disks that are clamped or fixed in some other way on a cylindrical carrier bar. Circular disks having a smaller diameter and made from elastic material alternate with circular disks that have a larger diameter and are made of a very wear-resistant material, specifically ceramic. The difference in the outside diameter makes for one-half the groove of peripheral grooves of the doctor bar that are formed between the various circular disks.

9 Claims, 1 Drawing Sheet

PROCESS FOR MANUFACTURING A DOCTOR BAR

This is a division of application Ser. No. 07/555,721, filed July 19, 1990 now U.S. Pat. No. 5,103,759.

BACKGROUND OF THE INVENTION

The invention concerns a doctor bar having surface grooves. Such a doctor is known from the U.S. patent document 3,084,663.

Extending essentially in the peripheral direction, the surface grooves of doctor bars of this type act as a rather accurate dosing means. However, the ribs remaining between the grooves or forming the grooves wear rather quickly in operation. Therefore, the tendency is to make the doctor bars from a maximally wear-resistant material, where the limits are reached soon though in terms of fabrication.

The problem underlying the invention consists in making a doctor provided with peripheral grooving, that is, so-called roll bar doctors, having a surface that is very resistant to wear.

SUMMARY OF THE INVENTION

This problem is inventionally solved by the features of the present invention. A doctor bar having surface grooves extending essentially in a peripheral direction is provided. The doctor bar comprises a generally cylindrical carrier bar, and a plurality of circular disks arranged on the carrier bar. The plurality of circular disks includes two types of disks. The first disk type consists of disks formed of a wear-resistant material, such as ceramic, and having a larger outside diameter. The second disk type consists of disks consisting of a substantially elastic material and having a smaller outside diameter. The larger outside diameter exceeds the smaller outside diameter by maximally 1.5 mm. The disks of the first disk type and the disks of the second disk type are arranged closely side by side and alternately on the carrier bar.

A process for manufacturing a doctor bar of the type having surface grooves extending essentially in a peripheral direction is also an inventive feature. A generally cylindrical carrier bar and a plurality of circular disks are provided. The circular disks have outside diameters that are substantially equal. The disks are of two different types. The first type includes disks that are formed of a wear-resistant material, such as ceramic, whereas the second type includes disks that consist of a substantially elastic material. The disks of the first type and the disks of the second type are arranged alternately in closely spaced side-by-side relationship on the carrier bar. The outside diameters of the disks are ground, and then the outside diameters of the disks of the second type are reduced to the required depths of the grooves, which exist between the disks of the first type. The outside diameters of the disks of the second type may be reduced, for example, by etching, or by electrodischarge machining or electrochemical erosion.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
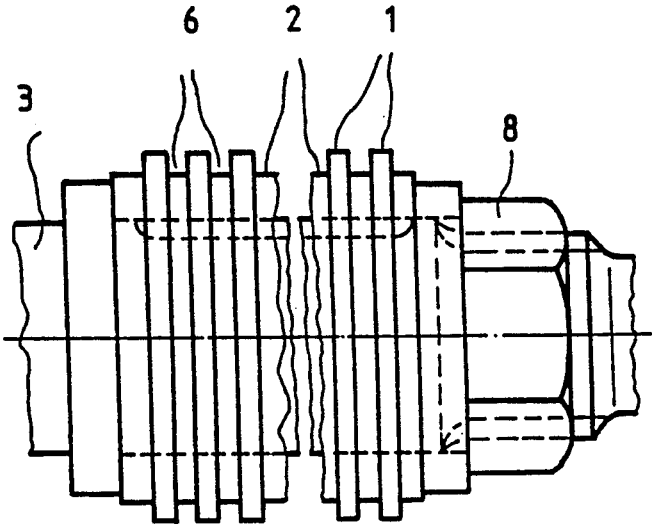
FIG. 1 is a side elevation of a doctor bar according to the present invention.

Circular disks 1 and 2 of different material are threaded side by side on a cylindrical carrier bar 3. The disks 2, with a smaller diameter consist, for example, of a regular steel, whereas the disks 1 of larger diameter are preferably made of ceramic, specifically ceramic oxide. The difference in diameter is selected according to the required depth of the grooves 6. It amounts generally to less than 1.5 mm, in which context presently an application of the doctor bar is preferably envisioned with groove depths of maximally 0.2 mm. These grooves are very difficult to make. On the other hand, when considering the slight groove depth, wear plays a particular role. Regular doctor bars, for example those made entirely from steel, have an operational service life which is much too short.

Figure 2:
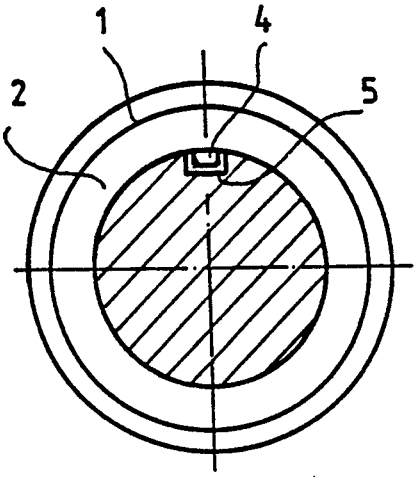
FIG. 2 is a cross section of an inventional doctor bar.

In these applications, the thickness of the circular disks ranges generally between 0.1 and 0.5 mm. The intermediate circular disks 2 are preferably made from an elastic material, for instance steel or a high-strength aluminum. They can preferably also be made somewhat thicker than the ceramic disks 1. This makes the entire bar more elastic with the result that deflections of the doctor bar will not so easily lead to excessive stresses on the relatively brittle ceramic disks 1. As can be seen from FIG. 2, the ceramic disks 1 may be fixed in peripheral direction by means of slot 5 and key 4, on the carrier bar 3. The entire package of circular disks is clamped down on both ends or on one end of the carrier bar 3, for instance by a nut 8. However, the circular disks can also be bonded mutually and to the carrier bar 3.

Another manufacturing process provides for alternating disks 1, 2 from different material and same outside diameter on the carrier bar 3, clamping them down and grinding the outside diameter as a whole. Thereafter, the spacer disks 2 can be reduced in their outside diameter to the desired groove depth by etching, in that the doctor bar is partly immersed in an etching bath and rotated until the required groove depth is reached. Also possible is an appropriate stock removal by electrodischarge machining or electrochemical erosion.

When the intermediate disks 2 consist, for example, of a high-strength aluminum, the carrier bar 3 should also be made from this material in order to obtain maximally equal coefficients of thermal expansion.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process for manufacturing a doctor bar of a type having surface grooves extending essentially in a peripheral direction, said process comprising:

providing a generally cylindrical carrier bar;

providing a plurality of circular disks having respective outside diameters, each of said outside diameters being substantially equal, said disks being generally of two different types, in which a first disk type consists of disks formed of a wear-resistant material, and a second disk type consists of disks consisting of a substantially elastic material;

fixing said disks of said first disk type and said disks of said second disk type alternately in closely spaced side-by-side relationship on said carrier bar;

grinding the outside diameters of said disks; and reducing the outside diameters of said disks of said second disk type so that surface grooves of a determined depth are formed in said doctor bar.

2. The process described in claim 1, wherein said outside diameters of said disks of said second type are reduced by etching away material from said outside diameters.

3. The process described in claim 1, wherein said outside diameters of said disks of said second type are reduced by electrical discharge machining.

4. The process described in claim 1, wherein said circular disks are mutually bonded on said carrier bar.

5. The process as described in claim 1, wherein said wear-resistant material is ceramic.

6. The process as described in claim 1, wherein each of said circular disks has a thickness of between 0.1 mm and 0.5 mm.

7. The process as described in claim 1, including locking means for locking at least said disks of said first type in a peripheral direction on said carrier bar.

8. The process as described in claim 7, wherein said locking means comprises a slot and key.

9. The process as described in claim 1, including means for clamping said disks together on said carrier bar.

* * * * *